United States Patent [19]

Young

[11] 3,978,612

[45] Sept. 7, 1976

[54] FLOWER POT HOLDER

[75] Inventor: Michael W. K. Young, Flushing, N.Y.

[73] Assignee: Oriental Buying Service, Inc., Wilmington, Del.

[22] Filed: May 30, 1975

[21] Appl. No.: 582,212

[52] U.S. Cl. ..... 47/40; 248/208; 248/206 R; 211/96; 47/39; 47/35

[51] Int. Cl.[2] ..... A01G 9/02

[58] Field of Search ..... 47/35, 36, 39, 40, 47; 211/86–100, 104; 248/206, 214, 215, 208, 213, 235, 305, 206 R

[56] References Cited

UNITED STATES PATENTS

| | | | |
|---|---|---|---|
| 231,976 | 9/1880 | Williams | 47/39 |
| 309,349 | 12/1884 | Hart | 47/39 |
| 888,032 | 5/1908 | Peterson | 248/215 |
| 1,530,407 | 3/1925 | Ranson | 211/100 |
| 2,029,246 | 1/1936 | McCarroll | 47/39 UX |
| 2,797,817 | 7/1957 | Shugarman | 211/96 |
| 2,868,387 | 1/1959 | Rucker | 211/96 |
| 2,919,881 | 1/1960 | Eames | 211/96 X |
| 3,018,898 | 1/1962 | Frazelle | 211/86 |
| 3,833,196 | 9/1974 | Protzman | 248/206 R |

FOREIGN PATENTS OR APPLICATIONS

| | | | |
|---|---|---|---|
| 607,482 | 12/1925 | France | 47/35 |

*Primary Examiner*—E. H. Eickholt
*Assistant Examiner*—James R. Feyrer

[57] ABSTRACT

A flower pot holder that is adapted to be affixed to the upper frame portion of a window sash that can be readily removed, the holder comprises a bracket member arranged to be placed over the upper frame portion of the sash with the lower end secured by a suction cup to a glass pane, pivotally mounted rod members are affixed to the vertical portion of the bracket in a key lock relationship to hold the rod member in a preselected position within a horizontal plane, the outward end of the rod member either terminating in a ring like portion adapted to receive the pot or terminating in a hook shaped portion adapted to receive chains from which rings are suspended that are adapted to hold the pots.

2 Claims, 16 Drawing Figures

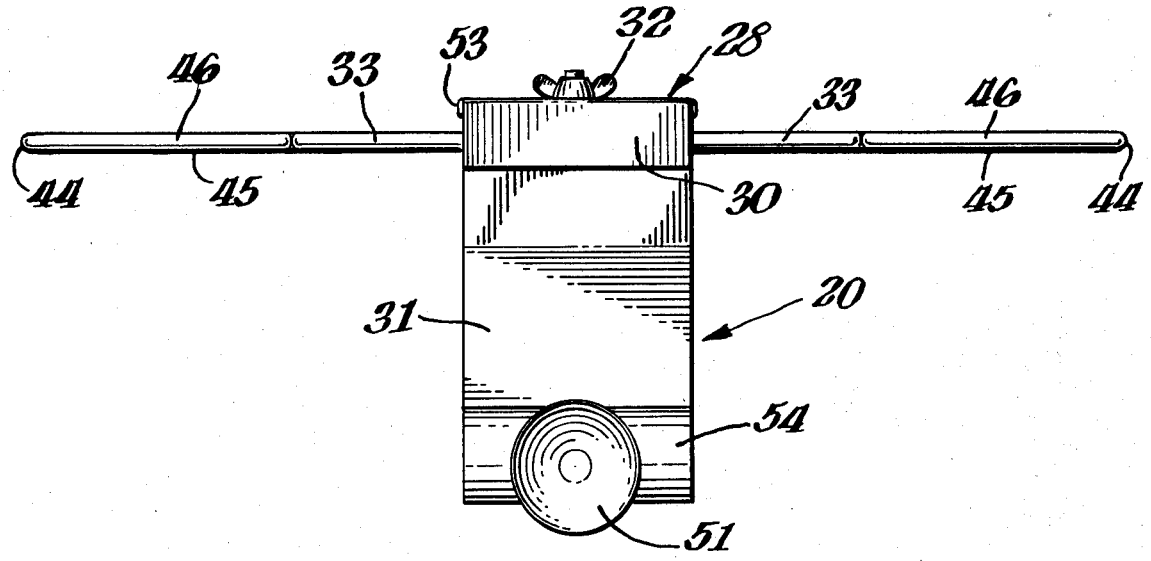
Fig. 5.
Fig. 12.
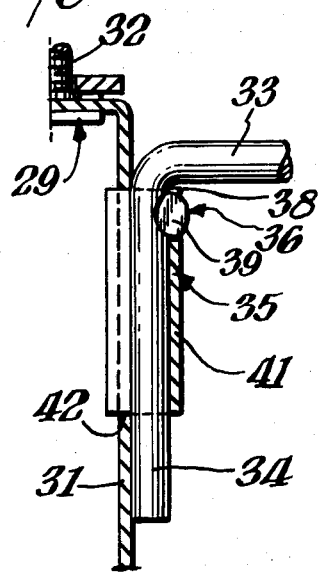
Fig. 13.
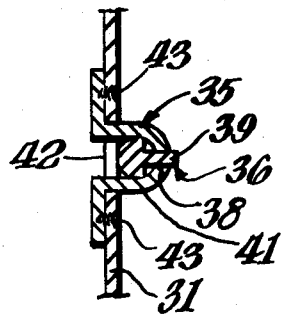

FLOWER POT HOLDER

BACKGROUND OF THE INVENTION

This invention relates to new and useful improvements in structural refinements in holders for flower pots. The apparatus of this invention involves a device for suspending a flower pot or a plurality of pots conveniently and effectively from the upper portion of a window sash. The holder may be conveniently removed from the window and is adjustable to mate with various thicknesses of window frames. While in place, the bracket is adapted to allow the window to be raised and lowered conveniently. The particular arrangement of parts of the instant invention provides a bracket in combination with a window sash that is capable of holding a great deal of weight without being permanently fixed to the window or window sash.

DESCRIPTION OF THE PRIOR ART

U.S. Pat. No. 2,536,901 to Bearden, dated Jan. 2, 1951, shows a flower pot holder in combination with a window and frame and sill. The holder of Bearden is typical of the state of the art in that the holder is permanently affixed to the window or sill and is not suspended from the upper frame portion in a two point attachment with the sash and movable therewith as in the instant invention. There are a number of other patents concerning various types of hangers but they do not teach nor disclose the arrangement of parts as claimed in the instant specification. Such patents include U.S. Pat. No. 1,955,223 to Brouyette, dated Apr. 17, 1934; U.S. Pat. No. 1,996,552 to Schwender, dated Apr. 2, 1935; U.S. Pat. No. 2,259,663 to Rosenthal, dated Oct. 21, 1941; U.S. Pat. No. 1,530,407 to Ranson, dated Mar. 17, 1925; and U.S. Pat. No. 2,500,881 to Stader, dated Mar. 14, 1950, to name a few.

SUMMARY OF THE INVENTION

The invention is described as a flower pot holder that is adapted to be affixed to the upper frame portion of a window sash that can be readily removed from the window sash. The holder comprises a bracket member having a portion that is adjustable and that can be placed over the upper frame portion of the sash and adjusted to tightly engage therewith with the remainder of the bracket portion extending downwardly with the lower end actually engaging the window pane of the sash to provide additional support and stability to the brackets. The downwardly disposed portion of the bracket member is adapted to receive pivotedly mounted horizontal rod members. The outer ends of the horizontally mounted rod members are adapted to receive the flower pots to be held. The end of the arms can be formed into a ring adapted to mate with and hold the flower pot, or the outer end of the rod can be adapted to receive chains from which are suspended rings adapted to mate with and hold the flower pot to be held.

DESCRIPTION OF THE PREFERRED EMBODIMENT

1. Brief Description of the Drawings

FIG. 5 is a rear elevational view of the flower pot holder illustrated in FIGS. 2–4.

FIG. 12 is a cross-sectional view taken along line 12—12 of FIG. 9.

FIG. 13 is a cross-sectional view taken along line 13—13 of FIG. 10.

Figure 1:
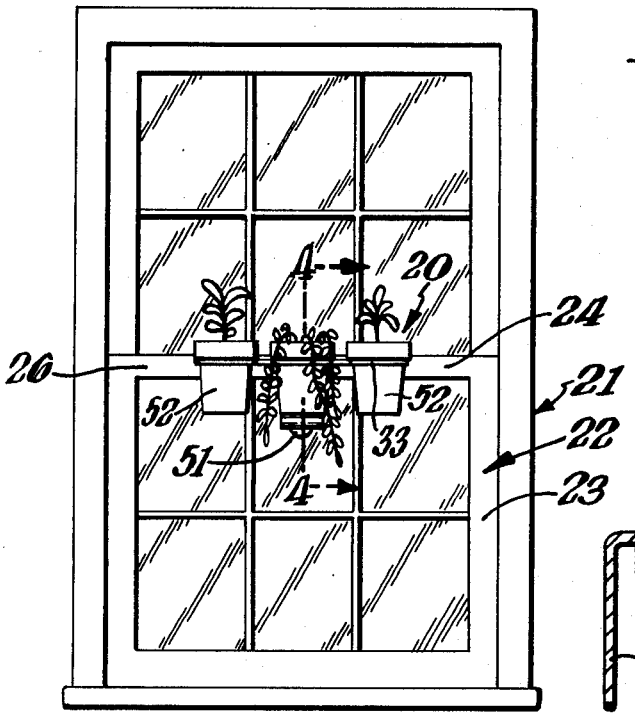
FIG. 1 is a pictorial representation of a flower pot holder of the instant invention in a place on the upper frame portion of a window sash.
Figure 7:
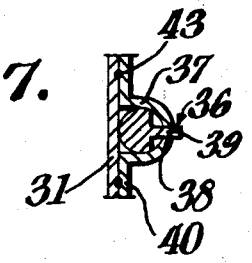
FIG. 7 is a cross-sectional view taken along line 7—7 of FIG. 4.
Figure 6:
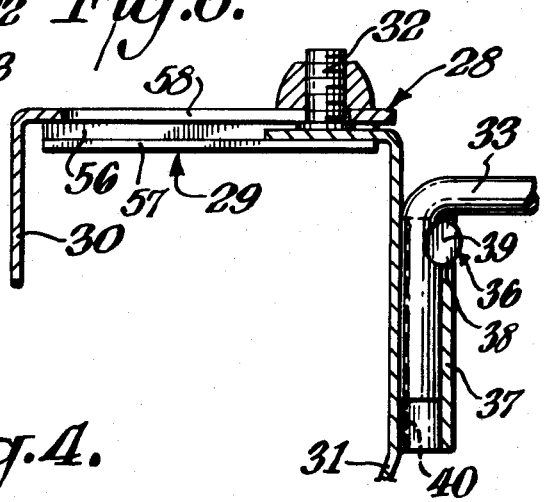
FIG. 6 is a cross-sectional view taken along line 6—6 of FIG. 3.
Figure 4:
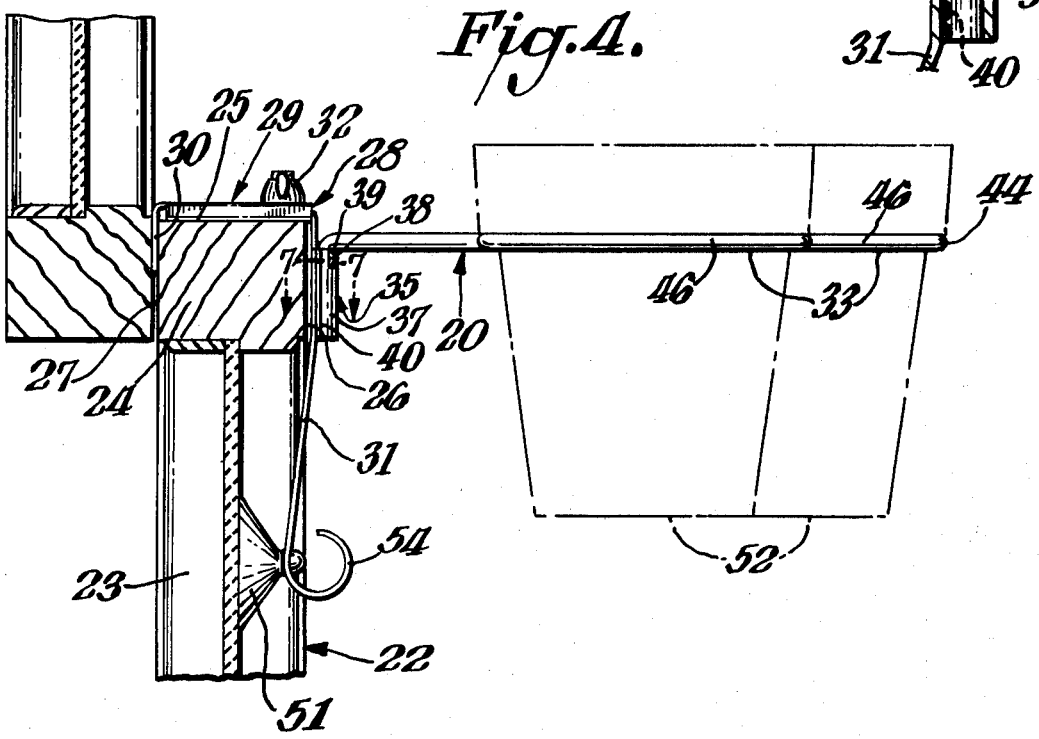
FIG. 4 is a cross-sectional view taken along line 4—4 of FIG. 1.

2. Detailed Description of the Preferred Embodiments.

Throughout this description the same numeral refers to the identical part throughout the specification and drawings.

Flower pot holder 20 is pictorially illustrated as being attached and associated with window 21 and suspended directly from sash 22 and more specifically suspended from the frame 23 of sash 22. Upper frame member 24 of sash 22 has a top portion 25, an interior front frame portion 26, and an exterior back frame portion 27. The bracket 28 for holding suspension rod members 33 has upper element 29 that is adjustable and in a slidable arrangement with respect to the normally downwardly extending bracket portion 31. Upper element 29 has a downwardly extending exterior portion 30 adapted to engage the exterior back frame portion 27. Screw means 32 are provided to secure upper element 29 to the normally downwardly extending bracket portion 31 to form a tight engagement with the upper frame member 24 of sash 22.

A flower pot suspension rod member 33 is attached via attachment means 35 to the normally downwardly extending bracket portion 31. Rod member 33 has an inward end 34 extending vertically downwardly that is pivotally connected with the downward extending bracket portion 31 through attachment means 35. Attachment means 35 has lock means 36 to hold said rod member in a fixed position within a horizontal plane. Attachment means 35 comprises an arcuate portion 37 that is designed to receive the inward end 34 of rod member 33. In addition, arcuate portion 37 has a slot 38 that is adapted to receive a protrusion 39 from rod member 33 to form a key lock relationship to hold rod member 33 in the desired position within the horizontal plane.

Figure 8:
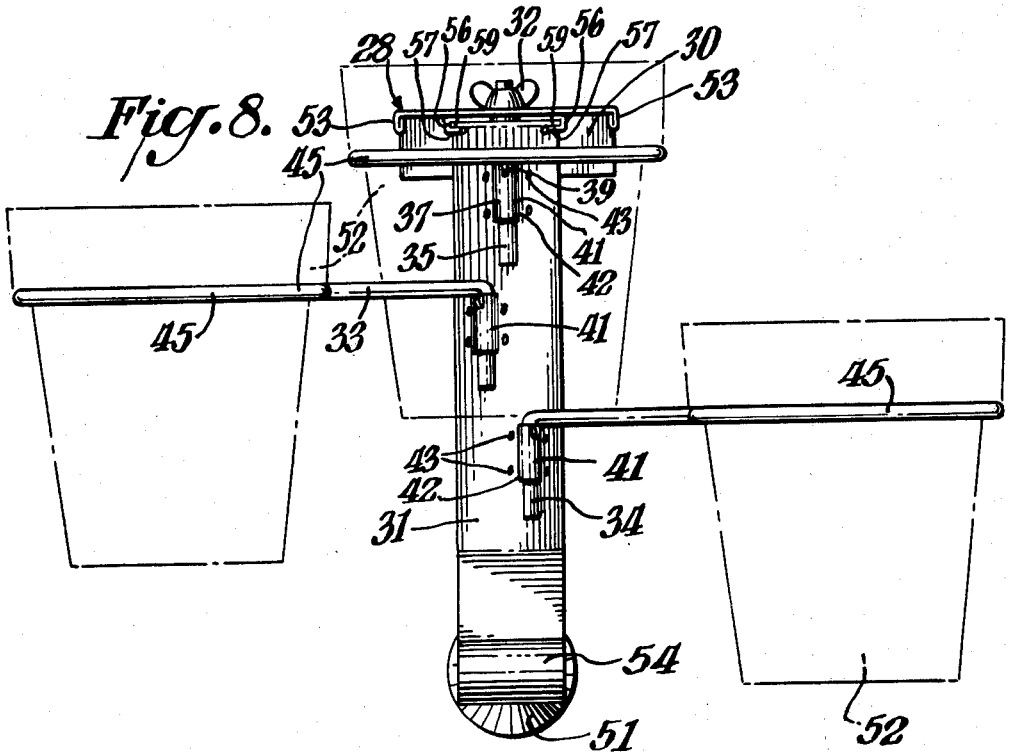
FIG. 8 is a front elevational view of an embodiment of the invention wherein three rod members having associated rings for receiving the pots are arranged vertically in a staggered row.

With respect to FIG. 8 attachment means 35 are illustrated as a separate arcuate formed piece of metal 41 for each rod member 33 that is attached to the normally downwardly extending bracket portion 31 with spot welds 43.

Figure 10:
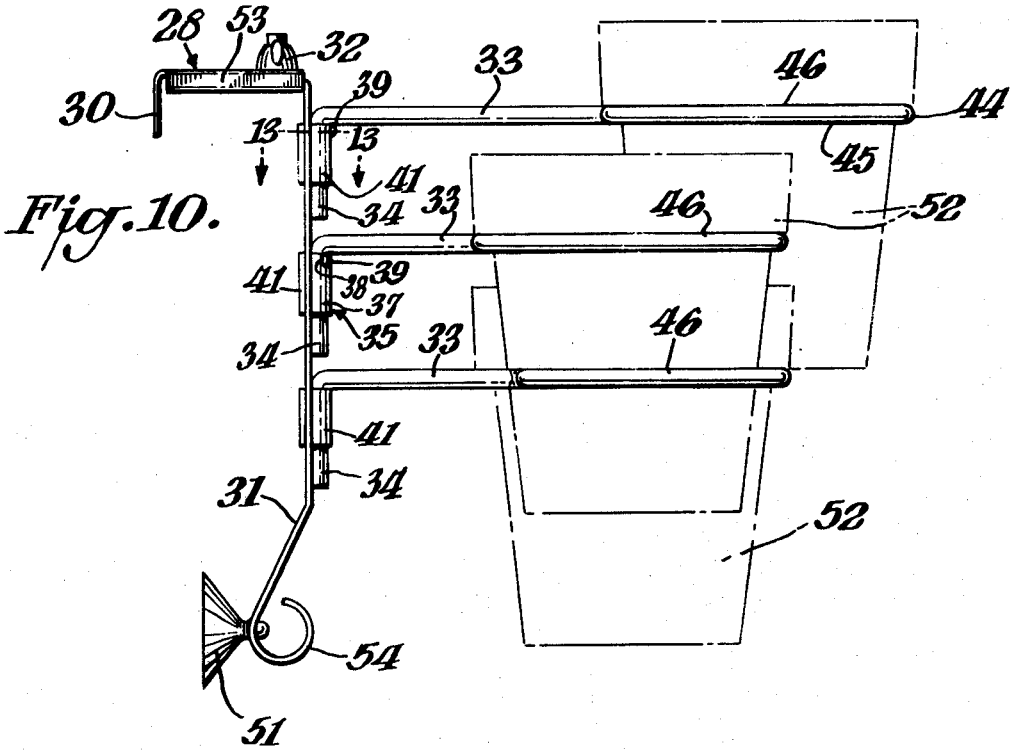
FIG. 10 is a side elevational view of the embodiment of the invention illustrated in FIG. 8.
Figure 11:
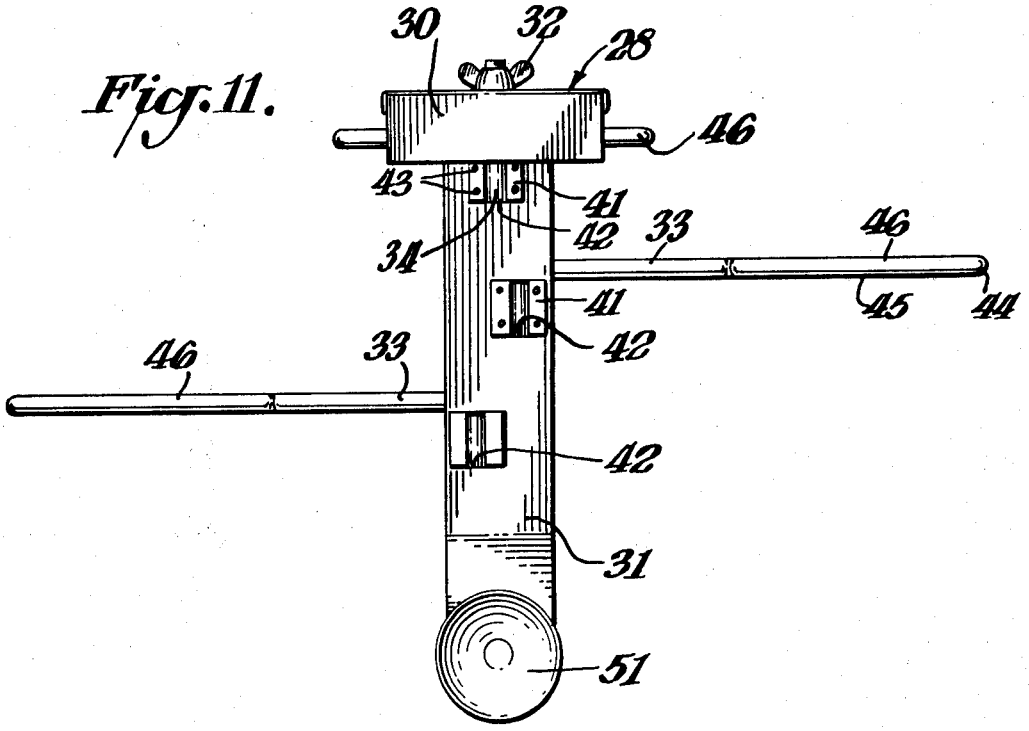
FIG. 11 is a rear elevational view of the embodiment of the invention illustrated in FIGS. 8 and 10.

FIG. 11 shows a rear elevational view of the embodiment shown in FIGS. 8 and 10 wherein holes 42 in bracket portion 31 are adapted to receive the arcuate portion 37 of attachment means 35. In this case the spot welds would be on the back side of bracket portion 31.

Figure 2:
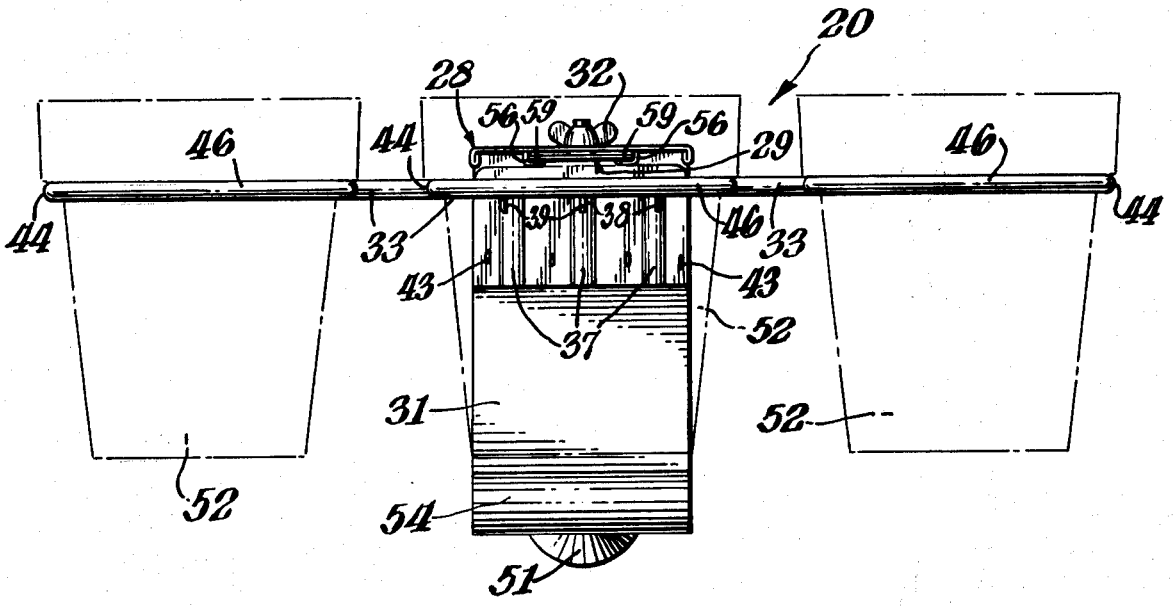
FIG. 2 is a front elevational view of a flower pot holder of the instant invention having means for holding flower pots in a substantial spaced alignment in the same horizontal plane.

In another embodiment of the invention the points of attachment of rod members 33 may be arranged in substantial horizontal alignment such as in FIGS. 1–5, 9 and 15. In such case the attachment means 35 and arcuate portion 37 may be formed of an individual single piece of metal 40 as illustrated in FIG. 2. In this case the single metal piece 40 could be spot welded to the front side of the normally downwardly extending bracket portion 31. Alternatively, the arcuate portions 37 of the single metal piece 40 could extend through holes cut into the bracket portion 31 and the spot welds located on the back rear side of bracket portion 31.

The outward end 44 of rod member 33 as shown throughout the figures has means 45 adapted to receive a pot to be held. The means for receiving the pot 52 to be held are generally illustrated as 45. In one embodiment of the invention as shown in FIGS. 1–5, 9 and 15 the outward end 44 of rod member 33 is formed into a ring-like member 46 that is adapted to receive and hold a flower pot 52 shown in phantom.

Figure 15:
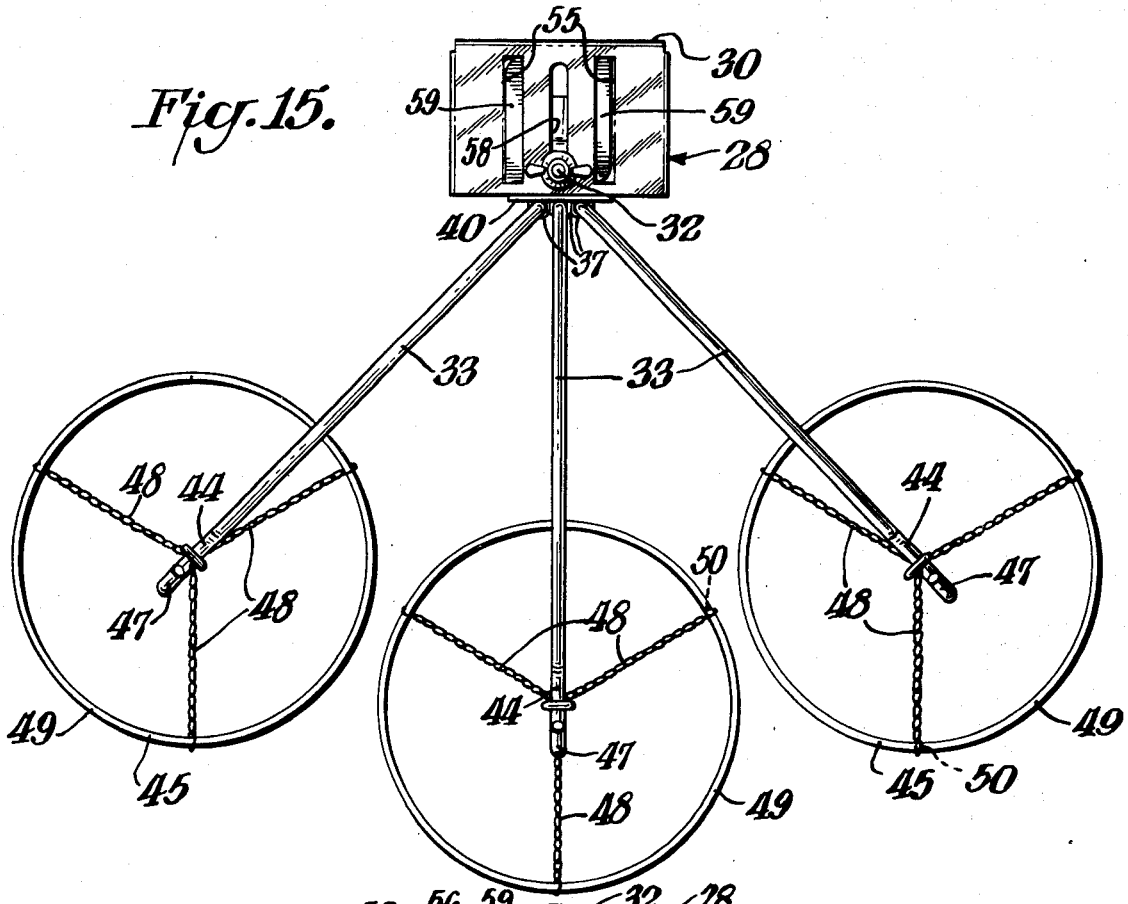
FIG. 15 is a top view of the embodiment illustrated in FIG. 14.
Figure 14:
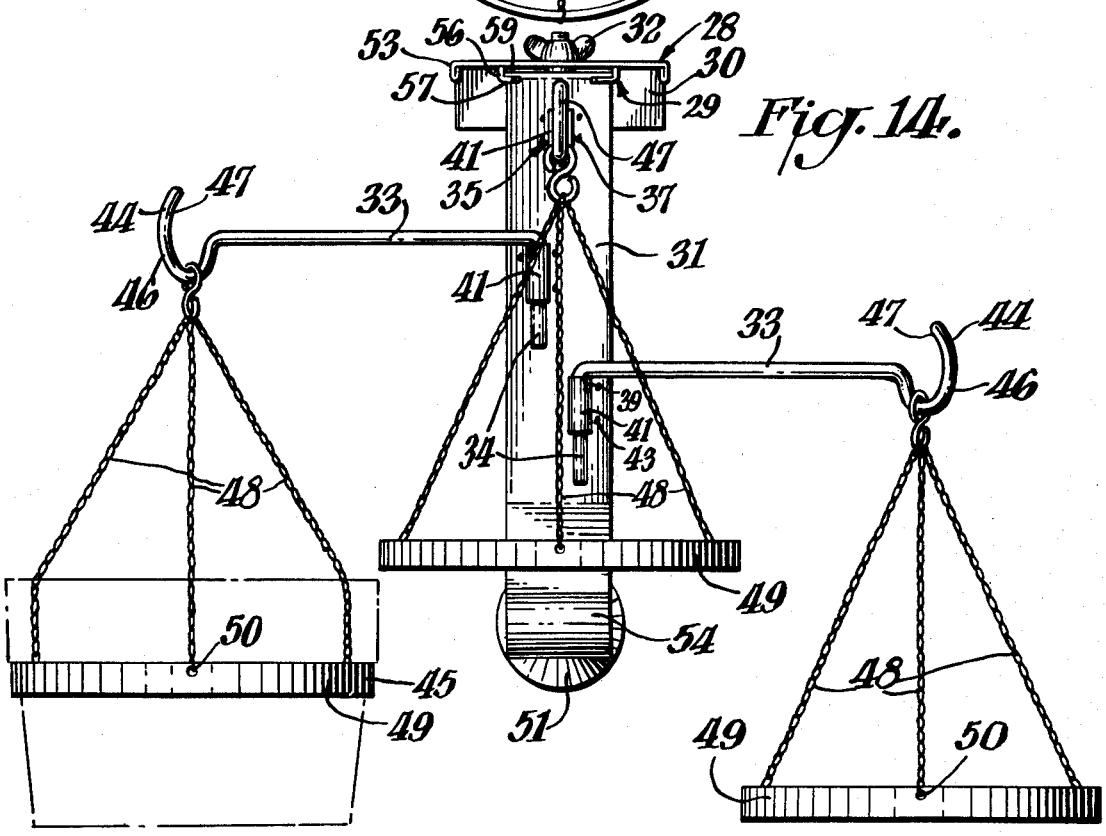
FIG. 14 is a front elevational view showing an embodiment of the invention having three rod members arranged in a staggered vertical row and the associated means for suspending the individual pots comprising a ring member attached to a plurality of chains.
Figure 16:
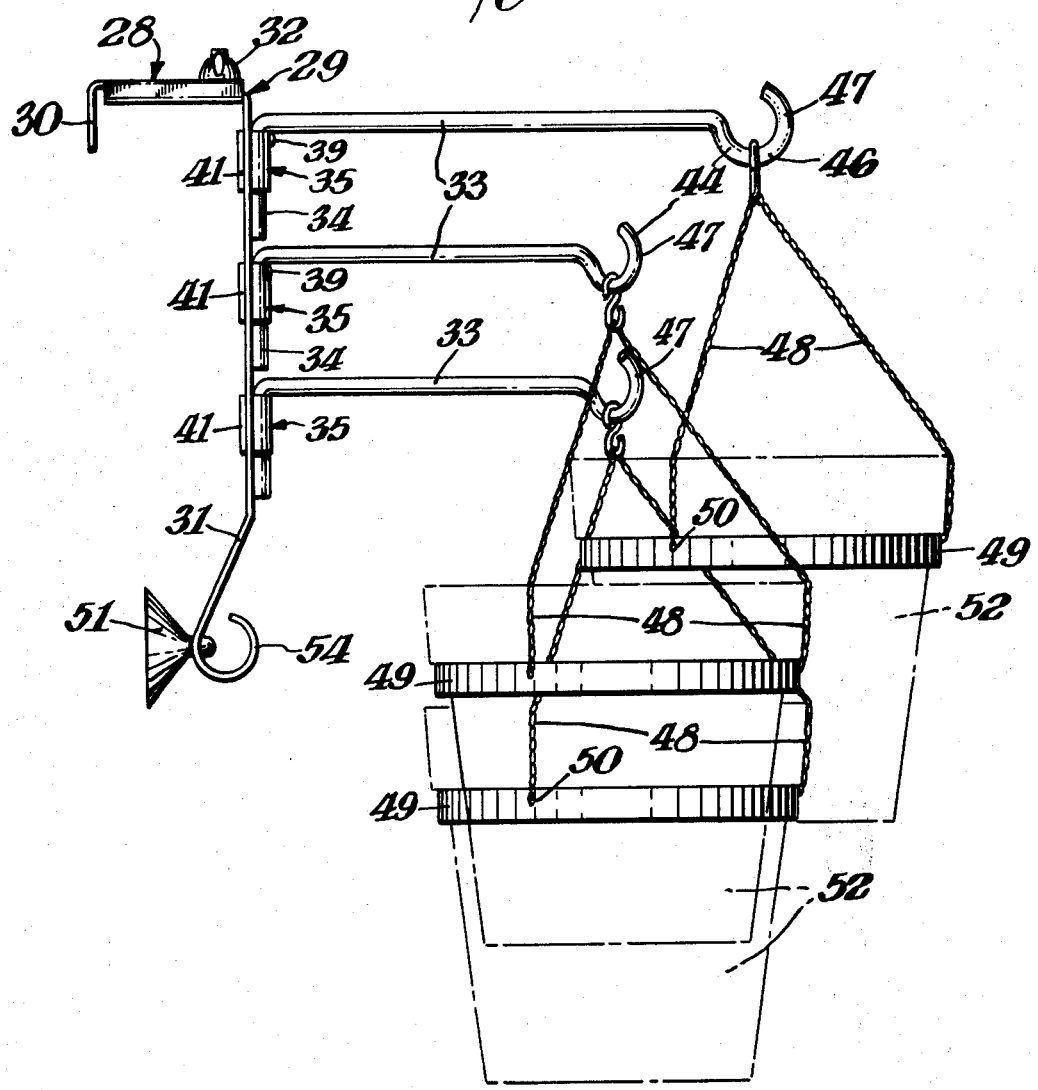
FIG. 16 is a side view of the embodiment illustrated in FIG. 14.

In other embodiments the means 45 for receiving the pot comprises the outward end 44 of rod member 33 being formed into a hook like configuration 47 as in FIGS. 14–16. In such an embodiment chains 48 may be suspended from hook 47 and the plurality of chains attached to ring 49 with points of attachment illustrated as 50.

Means 51 for temporarily engaging a pane of glass that is operatively associated with the lower end of the normally vertical portion of the bracket member 31 is illustrated as a rubber suction cup 51. Flower pots 42 are illustrated in phantom outline throughout the drawings.

For safety and pleasing ornamental effects the various edges of the part of the holder can be rolled over as illustrated in the figures. In addition, this adds to structural rigidity. The outward edges 53 of upper element 29 are turned under and inwardly to produce such effect. Likewise, the bottom portion of the normally downwardly extending bracket 31 is rolled upperwardly and inwardly to achieve this effect.

Figure 3:
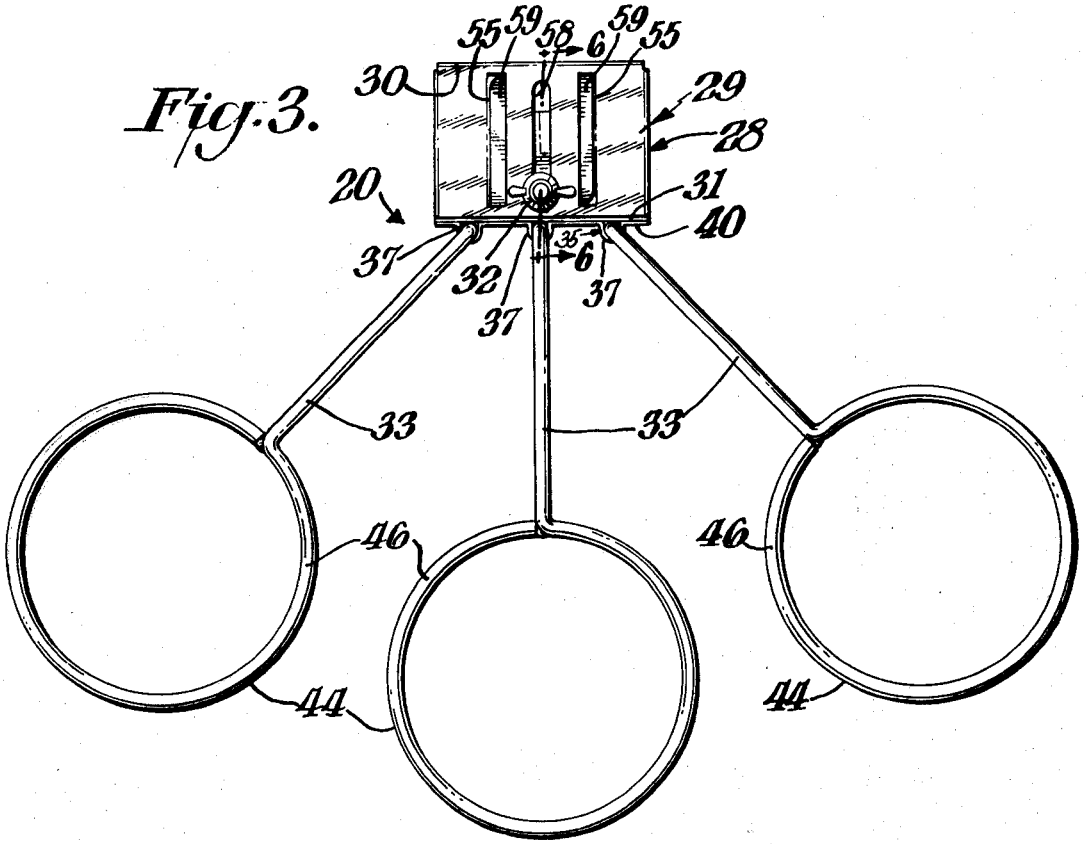
FIG. 3 is a top plane view of FIG. 2.
Figure 9:
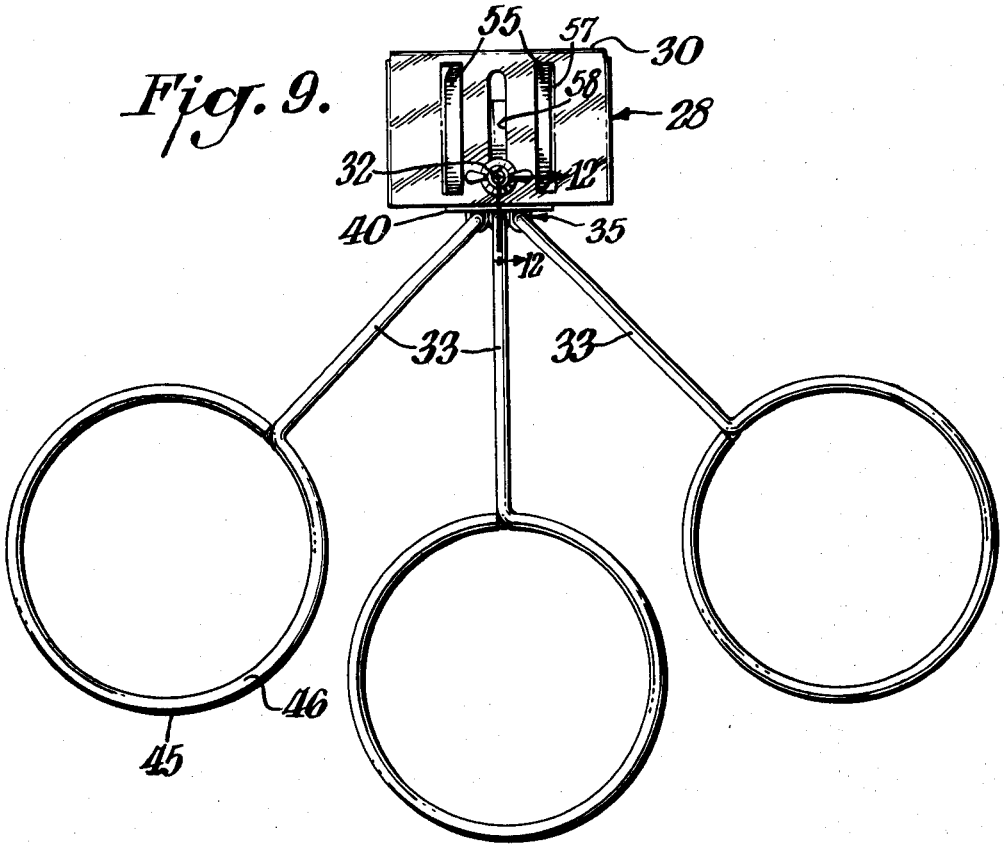
FIG. 9 is a top plane view of an embodiment of the invention having three rod members arranged in a horizontal relationship.

With particular reference to FIGS. 3, 9 and 15 slots 55 are cut into upper element 29 of bracket number 28 to form downwardly extending tabs 56 as seen in FIGS. 8 and 14. The tabs 56 can be crimped inwardly as at 57 to engage ears 59 of bracket portion 31 to provide a slidable and adjustable arrangement between bracket portion 31 and upper element 29. By crimping the tabs 56 around ears 59 as at 57 the screw means 32 can be a bolt having a head spot welded to upper element 29 so that screw means 32 will remain permanently in place. Such an arrangement provides for readily assembling the apparatus by inserting screw means through its slot 58 in upper element 29 and then crimping tabs 56 as shown at 57. Alternatively, the tabs 56 may be formed into a track arrangement by crimping as at 57 without screw means 32 being in place. With this arrangement it would be necessary to leave screw means 32 removable so that the apparatus could be assembled readily. Otherwise, a portion of ears 59 must be cut away at the corners to allow screw means 32 to fit into its associated slot 58 in upper element 29. Such a cutting away of the ears would be undesirable as the rigidity and strength of the bracket 28 would be diminished.

The apparatus of this invention is removable from the window sash and adjustable to fit standard window frames including Dormer windows and double hung windows. The apparatus is adjustable and can be clipped onto the window frame and secured by the suction cup for safety and stability. The apparatus of this invention with its associated flower pots will stay securely in place while the window is moving up to be opened or moving down to a closed position. The apparatus of the invention is easy to assemble without any tools and it is easy to install onto or remove from any double hung windows. The apparatus does not interfere with normal opening or closing of the associated window. The materials for preparing the invention are well known to those skilled in the art and require no special expertise. It is generally desirable for the bracket to be designed to hold at least 20 pounds when suspended from the rod members.

I claim:

1. In combination with a window having a sash comprising a frame having an upper frame member containing a top portion, an interior front frame portion, and an exterior back frame portion, a flower pot holder comprising:

a. a bracket comprising 1. an upper element adapted to rest upon said top frame portion having a downwardly extending exterior portion adapted to engage said exterior back frame portion, said downwardly extending exterior portion lying in a plane, said upper element further being arranged to mate in a slidable engagement with a horizontal portion of a normally vertical downwardly extending bracket portion, 2. a normally downwardly extending bracket portion having a top horizontal portion adapted to extend over said top portion of the upper frame member and to be in a slidable relationship with said upper element of said bracket screw means passing through said upper element and said top horizontal portion to selectively secure said upper element and said top horizontal portion together, said downwardly extending bracket portion extending down on the interior of said top frame member further than said downwardly extending exterior portion and including means at its lower end for attachment to a pane of glass held by said sash, said downwardly extending bracket portion having attachment means to receive a flower pot suspension rod member, said rod member having a normally vertical portion at one end to pivotally mate with said attachment means, a substantially horizontal portion intermediate its ends and a horizontal loop at its other end to encompass a flower pot, the sliding engagement of the top horizontal portion of said downwardly extending bracket portion and said upper element constituting adjusting means to enable mounting of said bracket on frames of varying thickness, the attachment means further having associated lock means to hold said rod member within a predetermined fixed position.

2. In combination with a window having a sash comprising a frame having an upper frame member containing a top portion, an interior front frame portion, and an exterior back frame portion, a flower pot holder comprising:

a. a bracket comprising 1. an upper element adapted to rest upon said top frame portion having a downwardly extending exterior portion adapted to engage said exterior back frame portion, said downwardly extending exterior portion lying in a plane, said upper element further being arranged to mate in a slidable engagement with a horizontal portion of a normally vertical downwardly extending bracket portion, 2. a normally downwardly extending bracket portion having a top horizontal portion adapted to extend over said top portion of the upper frame member and to be in a slidable relationship with said upper element of said bracket screw means passing through said upper element and said top horizontal portion to selectively secure said upper element and said top horizontal portion together, said downwardly extending bracket portion extending down on the interior of said top frame member further than said downwardly extending exterior portion and including means at its lower end for attachment to a pane of glass held by said sash, said downwardly extending bracket portion having attachment means to receive a flower pot suspension rod member, said rod member having a normally vertical portion at one end to pivotally mate with said attachment means, a substantially horizontal portion intermediate its ends and an operatively connected suspended ring member adapted to encompass a flower pot at the other end, the sliding engagement of the top horizontal portion of said downwardly extending bracket portion and said upper element constituting adjusting means to enable mounting of said bracket on frames of varying thickness, the attachment means further having associated lock means to hold said rod member within a predetermined fixed position.

* * * * *